US006160470A

United States Patent [19]

O'Carroll et al.

[11] Patent Number: 6,160,470

[45] Date of Patent: Dec. 12, 2000

[54] CIRCUIT BREAKER

[76] Inventors: Thomas O'Carroll, 7 College Ct., The Pines, Ballinasloe, Creagh; Desmond Regan, Carnaum, Kilrickle, County Galway, Loughrea; Dermot Hurst, Duneeda, County Galway, Ballinasloe, all of Ireland

[21] Appl. No.: 08/687,336

[22] PCT Filed: Jan. 23, 1995

[86] PCT No.: PCT/IE95/00006

§ 371 Date: Jun. 18, 1997

§ 102(e) Date: Jun. 18, 1997

[87] PCT Pub. No.: WO95/20236

PCT Pub. Date: Jul. 27, 1995

(Under 37 CFR 1.47)

[30] Foreign Application Priority Data

Jan. 21, 1994 [IE] Ireland ..... 940048

[51] Int. Cl.[7] ..... H01H 73/00; H01H 73/48; H01H 75/12

[52] U.S. Cl. ..... 337/82; 337/3; 337/13; 337/38; 337/45; 337/59; 200/286; 335/35; 335/45; 335/145; 335/176

[58] Field of Search ..... 337/82, 1, 3, 12, 337/13, 14, 35, 36, 37, 38, 45, 59, 112, 113; 200/400, 401, 293, 303, 286; 335/23, 35, 37, 43, 45, 145, 172, 173, 176

[56] References Cited

U.S. PATENT DOCUMENTS

| | | | |
|---|---|---|---|
| 3,818,168 | 6/1974 | Norden | 200/153 G |
| 5,075,657 | 12/1991 | Rezac et al. | 335/6 |
| 5,097,589 | 3/1992 | Rezac et al. | 29/622 |
| 5,381,120 | 1/1995 | Arnold et al. | 335/35 |
| 5,446,431 | 8/1995 | Leach et al. | 335/18 |
| 5,481,235 | 1/1996 | Heise et al. | 335/18 |
| 5,796,061 | 8/1998 | Fabrizi et al. | 218/157 |
| 5,821,839 | 10/1998 | Heise et al. | 335/35 |
| 5,831,500 | 11/1998 | Turner et al. | 335/17 |
| 5,831,501 | 11/1998 | Kolberg et al. | 335/42 |

FOREIGN PATENT DOCUMENTS

| | | | |
|---|---|---|---|
| 0469754A1 | 2/1992 | European Pat. Off. | H01H 71/74 |
| 11-3647 | 1/1999 | Japan | H01H 71/74 |

*Primary Examiner*—Leo P. Picard
*Assistant Examiner*—Anatoly Vortman

[57] ABSTRACT

A circuit breaker includes an upper rail mounting device defined by a line terminal having a pair of spaced-apart jaws. A bimetal is adjusted by means of a calibration screw. An aperture is provided in an upper sidewall portion of a base of the circuit breaker for access to the calibration screw by a calibration device. The aperture is positioned so that the calibration device must pass through the jaws of the upper rail mounting device. This ensures that the calibration screw can only be operated when the circuit breaker is disconnected from an electrical supply.

9 Claims, 4 Drawing Sheets

CIRCUIT BREAKER

BACKGROUND OF THE INVENTION

The invention relates to a circuit breaker. More particularly, the invention relates to a circuit breaker of the type comprising a base and a cover, the base and/or cover having a rear wall portion, a front wall portion and a pair of side wall portions extending between the front and rear wall portions to define an enclosure, upper and lower rail mounting devices extending from the rear wall of the housing, one of the rail mounting devices comprising a pair of spaced-apart jaws extending from the rear wall of the housing, a calibration access aperture extending through a wall of the housing through which access is gained to a calibration device in the enclosure.

Circuit breakers of this type are known. In conventional circuit breakers however the aperture through which access is gained to the calibration device in the enclosure is generally located in a position such that the calibration may be tampered with. In some cases the calibration aperture is covered by a separate cover, however, this is not entirely satisfactory as the cover may also be removed.

SUMMARY OF THE INVENTION

There is therefore a need for an improved circuit breaker which will overcome this difficulty.

This invention is characterised in that the calibration access aperture is located to permit access to the calibration device in the enclosure through the jaws of the rail mounting device.

The advantage of this arrangement is in locating the access to the calibration device in an inaccessible position so that the calibration cannot be easily tampered with and, more particularly, cannot be tampered with while the circuit breaker is in use. This removes the need to have a cover over the calibration device.

In one embodiment of the invention, the calibration access aperture extends through the housing between the jaws of the rail mounting device. This will generally be the most beneficial position for the calibration access aperture.

Preferably the calibration access aperture extends through a side wall portion of the housing. This arrangement facilitates access to the calibration access aperture when the circuit breaker is disconnected and dismounted from mounting rails.

To facilitate ease of operation with a simple operating device, preferably the calibration access aperture extends substantially parallel to a longitudinal axis of the rear wall of the housing.

In one embodiment of the invention, the upper rail mounting device comprises the pair of spaced-apart jaws. The particular advantage of this feature is that the upper rail mounting device is usually a line terminal for coupling to a source of electricity and the calibration cannot be tampered with without uncoupling the circuit breaker from the source of electricity.

In one arrangement, for simplicity of operation, preferably the calibration device comprises a calibration screw.

To facilitate ease of operation of the calibration screw, preferably the screw is rotatably mounted in a nut which is located in the housing.

For ease of assembly, preferably the screw is an interference fit in the circuit breaker housing.

In one embodiment of the invention, a bimetallic element is mounted in the enclosure and the calibration device comprises a calibration screw engaging the bimetallic element.

The invention will be more clearly understood from the following description thereof given by way of example only with reference to the accompanying drawings in which:—

DETAILED DESCRIPTION

Figure 1:
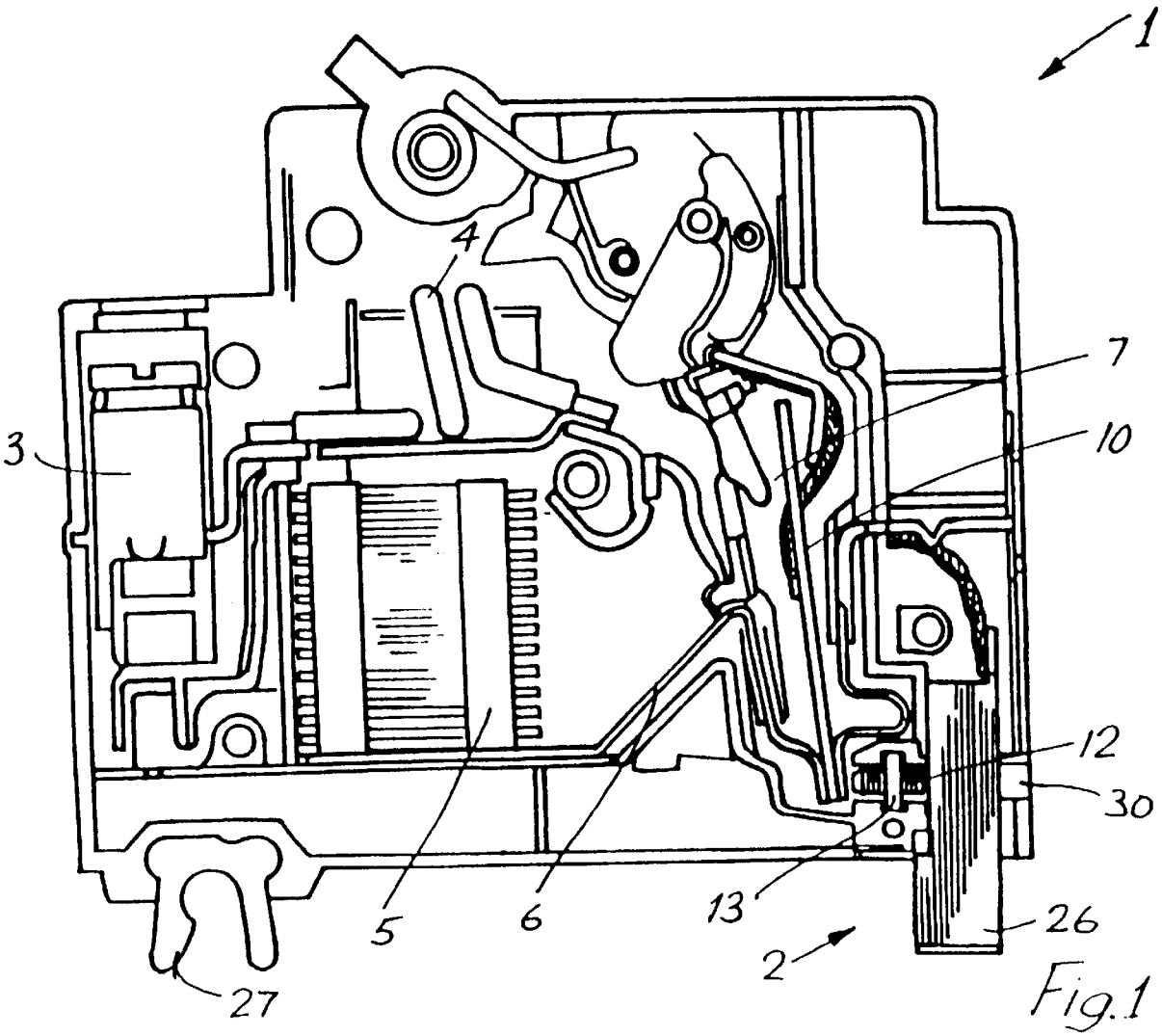
FIG. 1 is a plan view of a circuit breaker according to the invention with a cover removed.

Referring to the drawings, there is illustrated a circuit breaker 1 including a line terminal 2 for coupling to a source of electricity and a load terminal 3 for coupling to a load. The current path includes a coil 4 and an arc runner 6. An arc stack 5 assists in breaking any arc formed when contacts 7 are separated under load. The coil 4 causes separation of the contacts 7 in the event of a current surge. The contacts 7 may also be separated in response to operation of a bimetal 10. The bimetal 10 is adjusted by means of a calibration screw 12.

Figure 3:
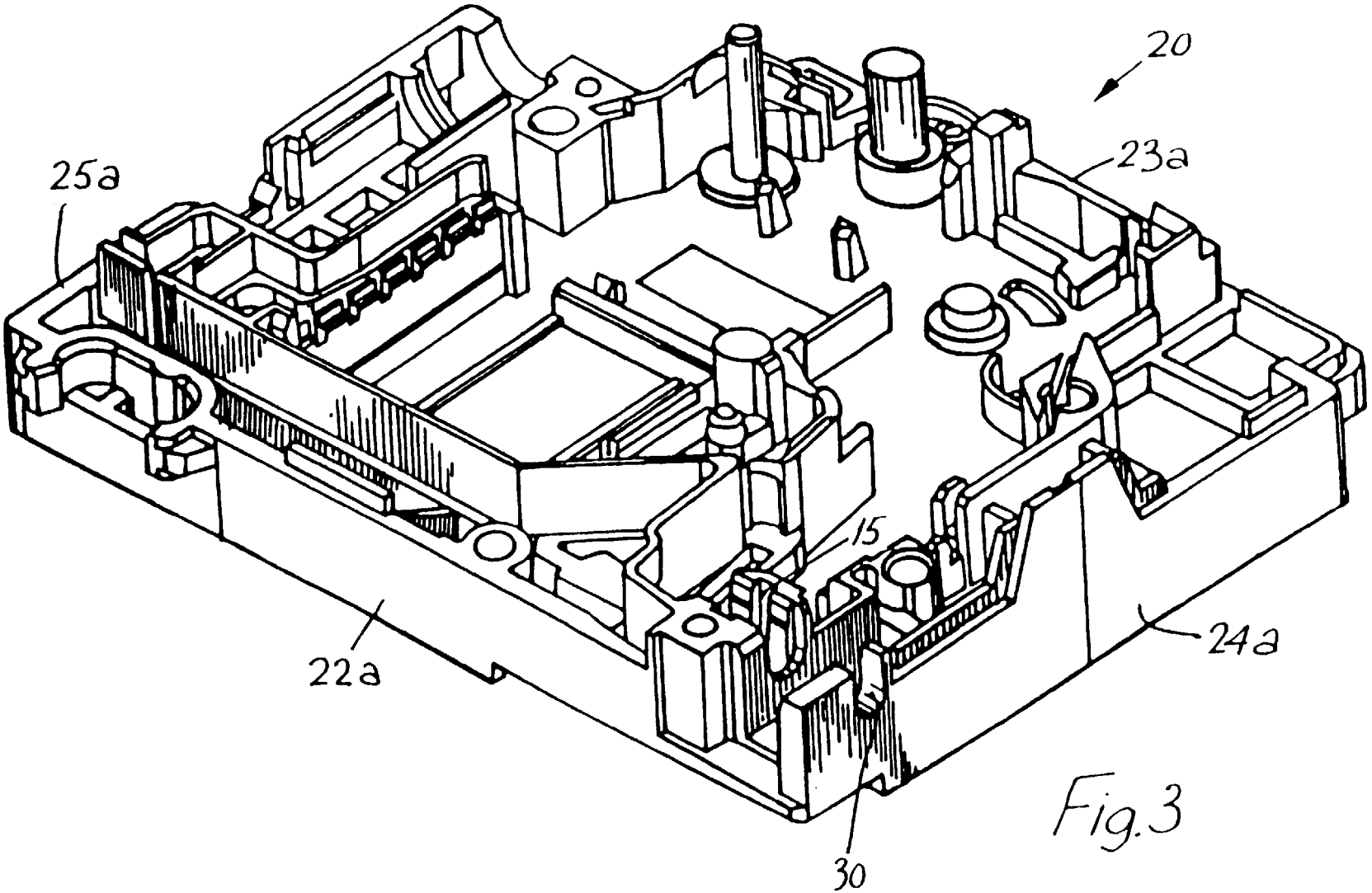
FIG. 3 is a perspective view of a base part of the circuit breaker.
Figure 4:
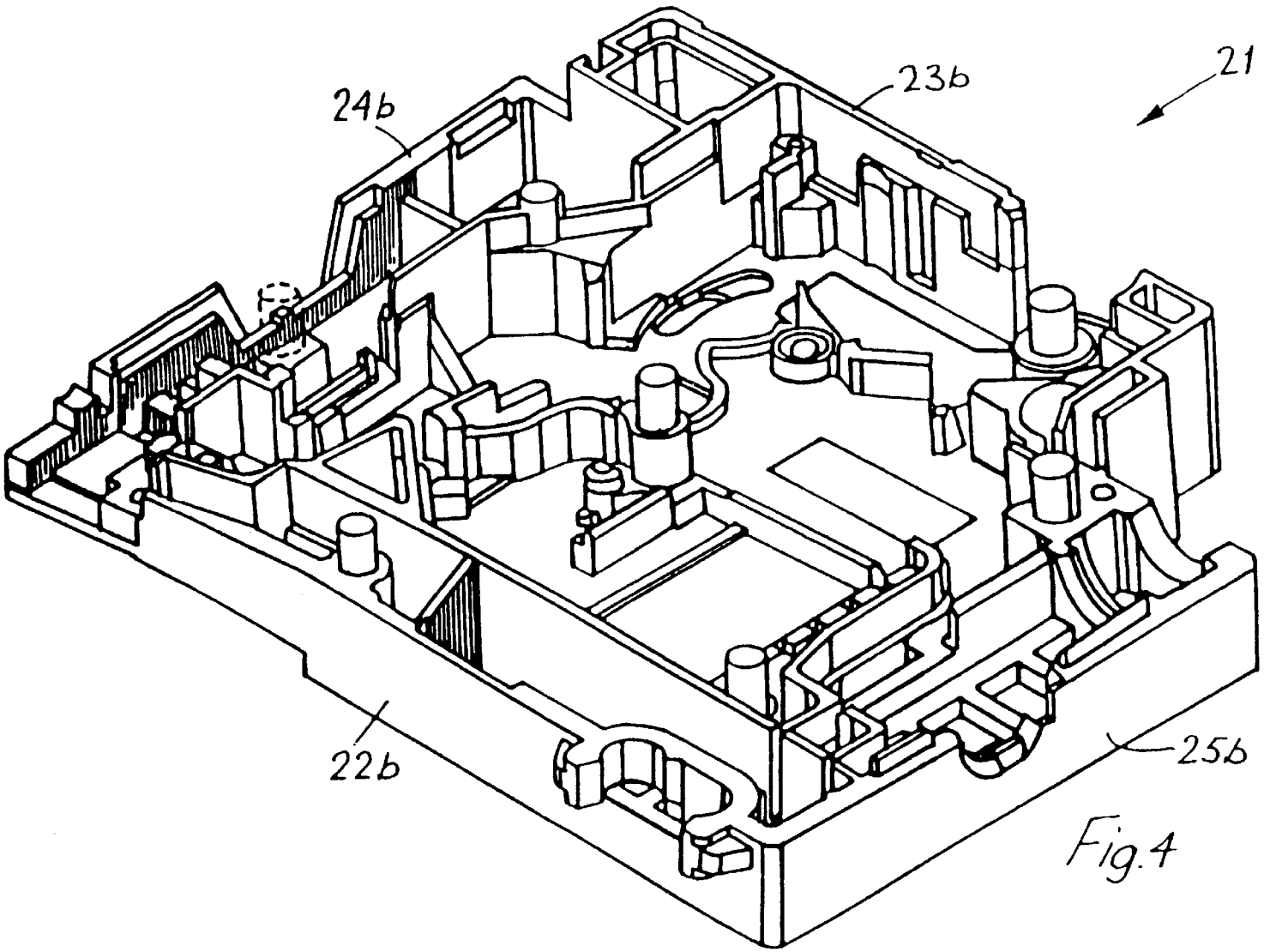
FIG. 4 is a perspective view of a cover part of the circuit breaker.

The circuit breaker 1 comprises a base 20 (FIG. 3) and a cover 21 (FIG. 4). The base 20 and cover 21 both have rear wall portions 22*a,* 22*b* respectively, front wall portions 23*a,* 23*b,* upper sidewall portions 24*a,* 24*b* and lower sidewall portions 25*a,* 25*b* respectively all of which cooperate on assembly of the base 20 and cover 21 to form an enclosure for the various components of the circuit breaker 1.

Upper and lower rail mounting devices 26, 27 extend from the rear of the housing. The upper rail mounting device 26 is defined by the line terminal 2 and includes a pair of spaced-apart jaws 31,32.

Figure 2:
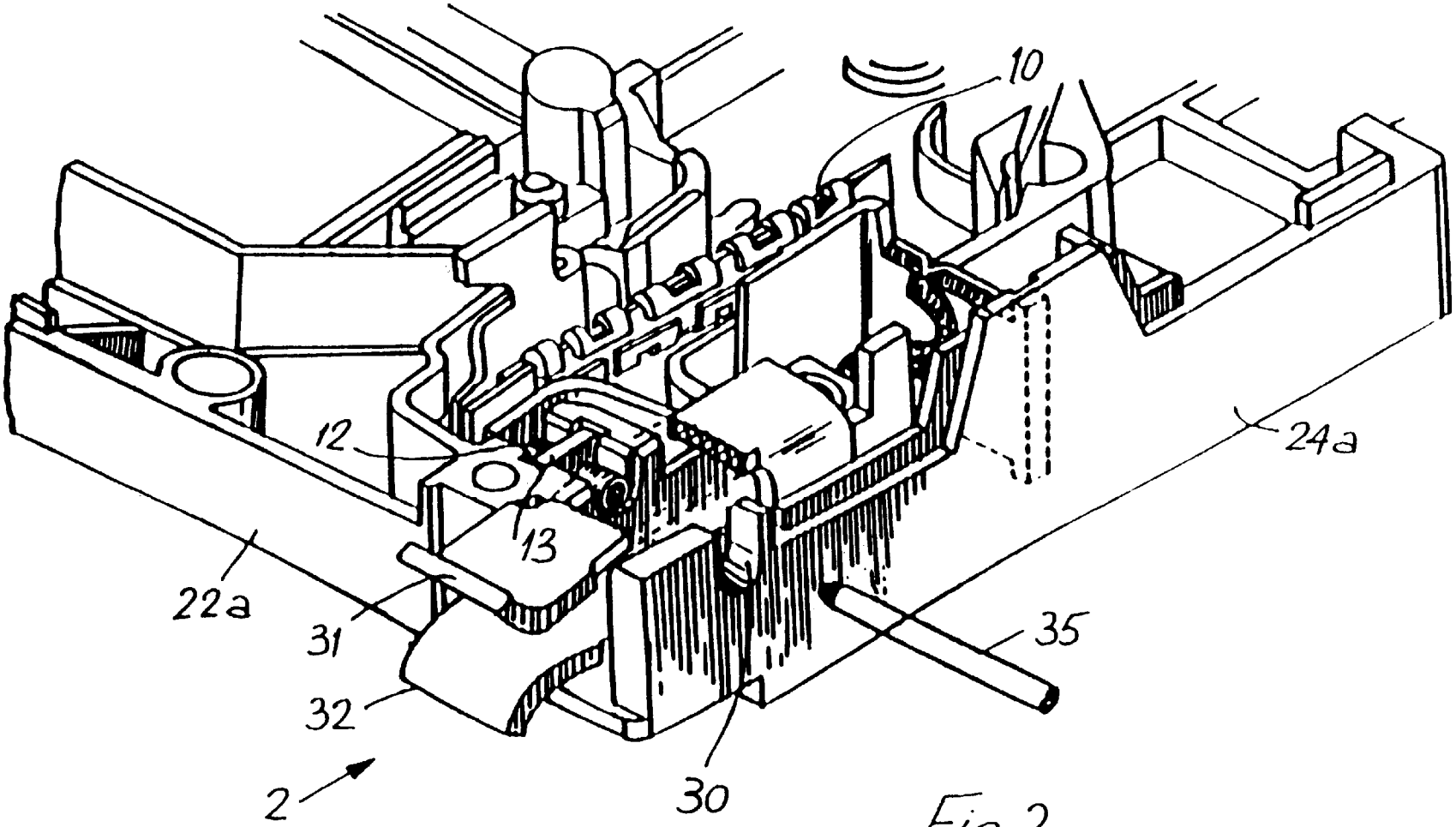
FIG. 2 is a perspective view of a detail of the circuit breaker of FIG. 1.

An aperture 30 is provided in the upper sidewall portion 24*a* adjacent to the upper rail mounting device 26 defined by the line terminal 2 for access to the calibration screw 12 by a calibration device 35, portion of which is illustrated in FIG. 2.

It will be noted that the aperture 30 is positioned so that the calibration device 35 must pass through the jaws 31,32 of the rail mounting device 26 to engage the calibration screw 12. This is particularly advantageous as it ensures that the calibration screw, 12 can only be operated when the circuit breaker is disconnected from the electrical supply, i.e. when the breaker is not in use.

A standard calibration screw 12 may be used. Typically the screw is contained within a nut 13 which is captive in a slot 15 in the base 20 of the enclosure. The locking of the screw 12 is achieved by an interference fit between the screw and the enclosure surface in the area of the nut 13.

The primary advantage of the invention is in providing necessary access to the calibration screw for calibration while ensuring that the circuit breaker must be disconnected from the supply for calibration.

Many variations on the specific embodiment of the invention will be readily apparent and accordingly, the invention is not limited to the embodiment hereinbefore described which may be varied in both construction and detail.

What is claimed is:

1. A circuit breaker comprising:

a housing defined by a base and a cover, the base and/or cover having a rear wall portion, a front wall portion and a pair of side wall portions extending between the front and rear wall portions to define an enclosure, upper and lower rail mounting devices extending from the rear wall of the housing, one of the rail mounting devices comprising a pair of spaced-apart jaws extending from the rear wall of the housing, and a calibration access aperture extending through a wall of the housing through which access is gained to a calibration device in the enclosure, wherein the calibration access aperture is located to permit access to the calibration device in the enclosure only through the jaws of the rail mounting device.

2. A circuit breaker as claimed in claim 1 wherein the calibration access aperture extends through the housing between the jaws of the rail mounting device.

3. A circuit breaker as claimed in claim 1 or 2 wherein the calibration access aperture extends through a side wall portion of the housing.

4. A circuit breaker as claimed in any of claim 3 wherein the calibration access aperture extends substantially parallel to a longitudinal axis of the rear wall of the housing.

5. A circuit breaker as claimed in any of claim 4 wherein the upper rail mounting device comprises the pair of spaced-apart jaws.

6. A circuit breaker as claimed in any of claim 5 wherein the calibration device comprises a calibration screw.

7. A circuit breaker as claimed in claim 6 wherein the calibration screw is rotatably mounted in a nut which is located in the housing.

8. A circuit breaker as claimed in claim 7 wherein the screw is an interference fit in the circuit breaker housing.

9. A circuit breaker as claimed in any of claim 8 wherein a bimetallic element is mounted in the enclosure and the calibration device comprises a calibration screw engaging the bimetallic element.

* * * * *